United States Patent [19]

Lions

[11] 4,014,295

[45] Mar. 29, 1977

[54] STEAM GENERATOR

[75] Inventor: Noël Lions, Manosque, France

[73] Assignee: Commissariat a l'Energie Atomique, Paris, France

[22] Filed: Feb. 4, 1976

[21] Appl. No.: 655,243

[30] Foreign Application Priority Data

Feb. 12, 1975 France ..... 75.04334

[52] U.S. Cl. ..... 122/32; 165/160

[51] Int. Cl.[2] ..... F22B 1/06

[58] Field of Search ..... 122/32, 33, 34; 165/145, 159, 160, 161

[56] References Cited

UNITED STATES PATENTS

| | | | |
|---|---|---|---|
| 2,655,346 | 10/1953 | Corbitt et al. | 165/160 X |
| 3,117,559 | 1/1964 | Fouché | 165/160 X |
| 3,183,969 | 5/1965 | Bell | 165/160 |
| 3,247,897 | 4/1966 | Ammon | 165/145 X |
| 3,279,439 | 10/1966 | Ammon | 122/34 |
| 3,628,507 | 12/1971 | Saporiti | 122/32 |

*Primary Examiner*—Kenneth W. Sprague
*Attorney, Agent, or Firm*—Cameron, Kerkam, Sutton, Stowell & Stowell

[57] ABSTRACT

Water is circulated within tube bundles located in spaced relation within the generator casing and converted to steam by exchange of heat with a liquid metal which is fed into the casing through a central axial tube. The liquid metal is distributed within adjacent compartments which are formed by radial partitions extending from the central tube and each accommodate at least one tube bundle. A small gap is formed between the radial partitions and the casing so as to provide a communication between adjacent compartments and to equalize the level of liquid metal.

13 Claims, 4 Drawing Figures

STEAM GENERATOR

This invention relates to a steam generator which is applicable in particular to an installation for generating electric power from the heat delivered by a nuclear reactor. Consideration is given primarily to a fast reactor which is cooled by circulation of primary fluid, especially a liquid metal. The primary fluid exchanges its heat in an intermediate heat exchanger with a secondary fluid which is usually of the same type. The secondary fluid then flows through the steam generator in contact with the external walls of a bundle of tubes supplied with water which is thus caused to evaporate. In the following description, a steam generator of this type will be designated by the expression "steam generator of the type specified".

In steam-generating units of this type which are at present known and adapted to high thermal power ratings of the order of 750 MW(th), for example, the unit is usually provided with an outer casing in which is circulated the liquid metal employed for delivering heat. Said casing is traversed by a bundle of tubes which are connected through tube-plates to manifolds respectively for supplying water to the steam-generator inlet and for discharging steam at the generator outlet. Said tube bundle can pass right through the outer casing so that the ends of the bundle are connected to two tube-plates which are usually parallel. Alternatively, it is possible to employ tubes of the hair-pin type or any other tube configuration in order to extend the water circulation path within the generating unit and to improve the steam production efficiency. However, in the designs just mentioned, the tube bundle is constructed either in the form of a single-unit assembly which occupies the greater part of the volume provided withn the outer casing or in a plurality of separate and adjacent modules, the tubes of these modules being connected to common tube sheets carried by the outer casing. In these design solutions, however, certain problems arise in regard to inspection and maintenance of the tubes.

It is in fact known that the major problem presented by the operation of steam generators of the type specified results from the potential dangers of violent reactions between the water which circulates within the tubes of the bundle and the liquid metal which is contained in the steam-generator casing and surrounds these latter externally; as a general rule, the liquid metal consists of sodium or of a sodium-potassium alloy. In the event of out-leakage from one or a number of tubes of the bundle and depending on the leakage rate, a violent reaction in fact takes place with the sodium and must essentially be confined to the maximum extent, especially before this reaction causes damage to tubes located in the vicinity of the leak or even to the generator casing or the tube-sheets associated with the casing. The solution usually consists in locating the leak as rapidly as possible by detection of the hydrogen produced by the reaction, then in closing-off the faulty tube, especially by plugging.

In known designs of steam generator of the type specified, however, the practical arrangements adopted for the tube bundle hardly make it possible to prevent propagation of the effects produced by the fault condition which has been detected; in the event of violent reactions and substantial leakages, there is no means of ensuring rapid discharge of the entire mass of water contained in the steam-generating unit. Moreover, in the event of lower leakage rates, it still remains necessary to isolate the entire unit in order to carry out detection of the defective tube and subsequent plugging, which is a serious drawback. Finally, in the case of more extensive repair work, the tube bundle must be completely removed from the casing. This results in appreciable loss of time as well as delicate and costly handling operations, especially in the case of high power generators in which the units are of large size.

The present invention is concerned with a novel arrangement for a steam generator of the type specified which offers a high degree of reliability allied with enhanced ease of operation and maintenance. A noteworthy consequence lies in the possibility of rapid and efficient remedial action in the event of leakage from any one tube of the bundle and resultant reaction of the water in said tube with the liquid metal.

To this end, the steam generator under consideration comprises a closed outer casing of revolution about an axis, a liquid metal being circulated within said casing, and a plurality of tube bundles traversed by water in the liquid state to be converted to steam by exchange of heat with the liquid metal, said tube bundles being arranged in spaced relation within the casing so as to constitute independent modules extending parallel to the axis of the casing. The steam generator is characterized in that liquid metal is supplied to the casing along its axis through a single central tube provided with distribution orifices for the flow of liquid metal into adjacent compartments formed in the casing by means of radial partitions extending from the central tube in planes which contain the axis of the casing, each compartment being such as to contain at least one modular tube bundle, the tubes in each modular bundle being adapted to pass through the casing and the ends of said tubes being connected externally of said casing by means of a tube-plate to two separate headers respectively for the admission of water and the discharge of steam.

In a preferred embodiment of the invention, the outer casing is constituted by a lateral cylindrical shell having a vertical axis and closed by two substantially spherical dished ends, liquid metal being circulated downwards within said casing whilst water is circulated upwards within the tubes of the modular bundles in counterflow to the liquid metal.

In accordance with a particular feature of the steam generator under consideration, the radial partitions which delimit the compartments within the outer casing form a small radial gap with the internal surface of said casing in order to permit a communication between the compartments and to equalize the level of liquid metal within these latter.

In accordance with a further characteristic feature, the central tube for supplying liquid metal within the outer casing is constituted by a cylindrical duct, the distribution orifices being located at the ends of elbowed portions carried by said duct. As an advantageous feature, the arrangement of the orifices and the rate of flow of the liquid metal are so determined that a volume of neutral gas can be present above the level of liquid metal within the casing in order to damp the pressure waves in the event of leakage of a tube and reaction between the water and the liquid metal.

In a preferred embodiment of the invention, the discharge of liquid metal from the outer casing is carried out by means of a single central duct mounted on the bottom end of the casing in the line of extension of the central feed tube. The central tube is preferably extended to the vicinity of the discharge duct and the end of said tube has a contour of revolution with a profiled generator-line for facilitating the outflow of liquid metal from the outer casing. By way of alternative, the bottom end of the outer casing is provided beneath each compartment with a duct for the discharge of liquid metal.

Advantageously and irrespective of the alternative embodiment adopted, the discharge duct is provided externally of the casing with a safety bursting disc so as to permit rapid emptying of the compartments in the event of a violent sodium-water reaction.

So far as the tube bundle is concerned, different solutions can be adopted. In particular, the tubes of each modular bundle can be straight tubes parallel to the axis of the outer casing whilst the tube-plates of the end headers extend in a horizontal direction, said tubes being provided if necessary with expansion bends in the vicinity of the tube-plates.

In accordance with another mode of construction, the tubes within each modular bundle can be brought closer together in the vicinity of their connection with the tube-plates and spaced at a greater distance from each other within the interior of the compartments formed in the outer casing. This solution makes it possible to ensure a better distribution of said tubes within the compartments.

Further characteristic features of a steam generator of the type specified and constructed in accordance with the invention will become apparent from the following description of one exemplified embodiment and several alternative forms of construction which are given by way of indication without any limitation being implied, reference being made to the accompanying drawings, wherein.

Figure 1:
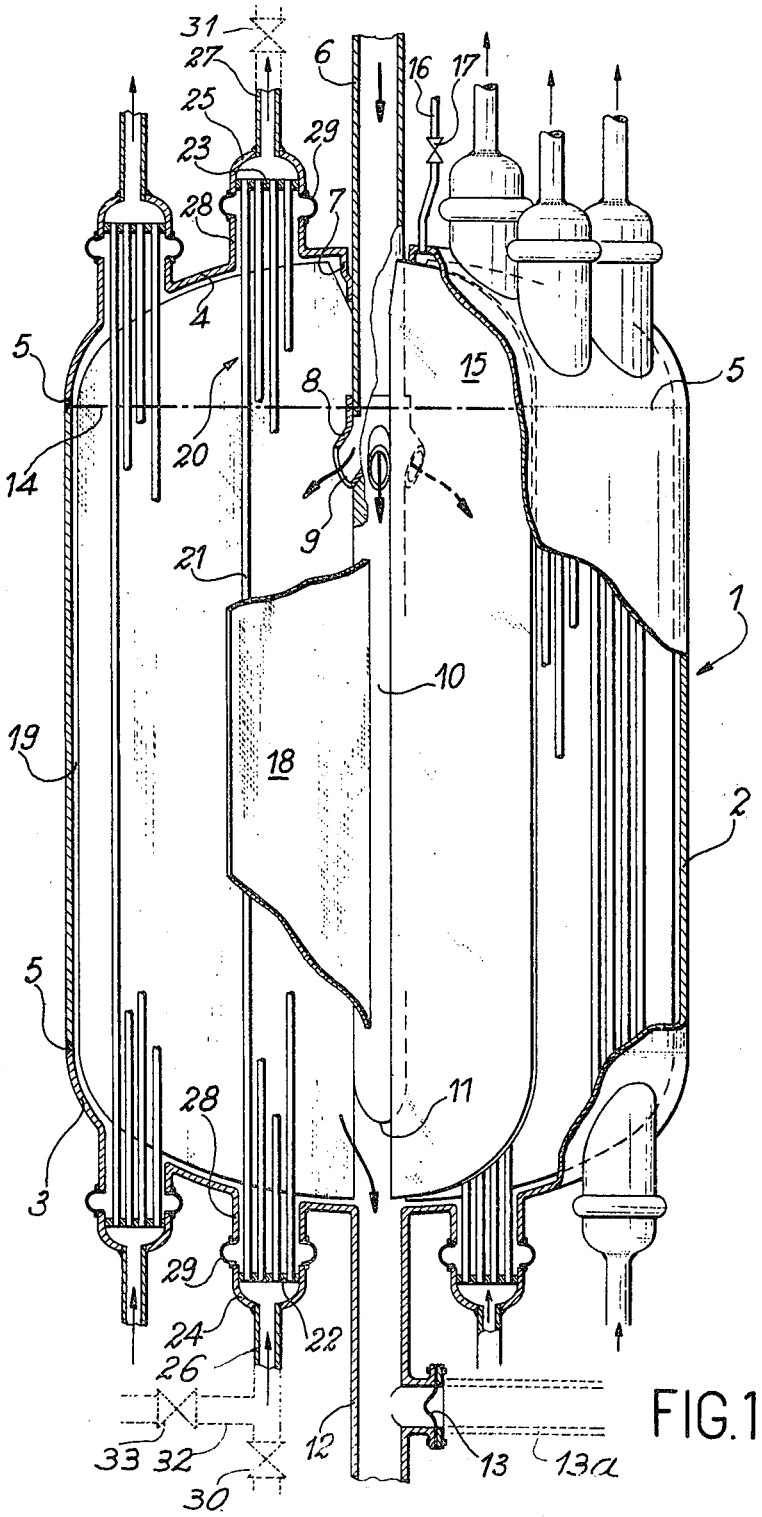
FIG. 1 is a diagrammatic vertical sectional view in perspective with parts broken away and showing a steam generator in accordance with the invention.

In FIG. 1, the reference numeral 1 designates the outer casing of the steam generator under consideration, said casing being constituted by a lateral cylindrical shell 2 having a vertical axis in the example which is illustrated. Substantially spherical dished ends 3 and 4 respectively are joined to the ends of said shell by means of weld fillets 5, for example. A flow of liquid metal usually consisting of sodium and intended to deliver heat in order to produce the steam within the generating unit is circulated within the interior of the outer casing aforesaid. Said liquid metal is supplied through a central feed tube 6 which penetrates into the casing through the top end 4 and is joined to the central portion of this latter by means of a connecting sleeve 7. The central tube 6 is provided at the lower end thereof with a series of elbowed portions 8 which are uniformly spaced about the axis of the tube 6. Said portions are provided with end orifices 9 for distributing the flow of liquid metal from the tube 6 around this latter inside the casing within different compartments formed in said casing in a manner which will be described hereinafter.

The central tube 6 is extended beneath the portions 8 by an axial body 10 which extends within the interior of the casing 1. The lower extremity 11 of said axial body which is located in the vicinity of the central portion of the bottom end 3 is suitably shaped so as to promote the flow of liquid metal externally of the casing 1 through a central discharge duct 12. Said duct is provided externally of the casing 1 with a safety bursting disc 13 which is intended to permit rapid draining-out of the casing 1 in the event of abnormal overpressure within said casing, the products of the reaction between the sodium and the water being discharged to a header (not shown) through a duct 13*a*. There is present above the level of liquid metal within the casing as shown at 14 in the drawing a suitable volume 15 of a neutral gas under pressure. This gas is fed into the interior of the casing through a pipe 16 fitted with a regulating valve 17 with a view of limiting the pressure waves in the volume of liquid metal in the event of a violent reaction of the water with said liquid metal and appreciable evolution of hydrogen.

In accordance with the invention, the interior of the casing 1 is subdivided into separate but adjacent compartments by means of radial partitions 18 which are rigidly fixed over the greater part of their height by welding to the central tube 6 and to the axial body 10. Said radial partitions 18 extend in the direction of the lateral shell 2 and of the ends 3 and 4 and form with these latter a narrow gap 19, with the result that the different compartments thus formed within the casing are permitted to communicate with each other and that the level 14 of liquid metal is maintained at a substantially identical valve within said compartments. Supporting of the partitions 18 by means of the central tube and its axial extension can also be completed by means of fixing lugs (not shown) which are welded between the partitions and the top end 4 of the enclosure. As an advantageous feature, the bottom end 3 can be provided with guiding members, for example in the form of stirrup-pieces (also omitted from the figure), in which are engaged the bottom edges of said partitions. By virtue of these arrangements, the partitions can readily be removed together with the central tube 6 for repairs or maintenance, simply after cutting of the top end 4.

Also in accordance with the invention, the compartments which are thus delimited between the adjacent partitions 18 are traversed by modular bundles 20, three bundles being provided per compartment in the example under consideration and each constituted by an assembly of tubes 21 which extend parallel to the axis of the casing 1. Said tubes 21 pass through the ends 3 and 4 and are connected to tube-plates which, in the example of construction illustrated in the figures, extend in a horizontal direction and are designated respectively by the reference numerals 22 and 23, depending on whether they are placed above or beneath the ends 3 and 4. Said tube-plates delimit with water-boxes 24 and 25 two headers provided respectively for the supply of the tubes 21 with water in the case of the box 24 and for the discharge of the steam produced through the generator in the case of the box 25. The supply of water and discharge of steam takes place from each water-box through pipes 26 and 27 respectively. The water-boxes 24 and 25 are connected to the dished ends 3 and 4 of the casing 1 by means of sleeves 28 which are each fitted with a bellows seal 29 for accommodating corresponding differences in expansion between the shell 2 and the tubes 21. Provision is made in the pipe 26 for a valve 30 which serves to isolate the water-box 24 from a supply tank (which has not been shown in the drawings). Similarly, the pipe 27 is fitted with a valve 31 between the water-box 25 and a steam header (again not shown). Finally, provision is made on the pipe 26 for a branch pipe 32 which is fitted with a valve 33 and connects said pipe 26 to a circulation system for the discharge of water from the tubes of the modules.

Figure 2:
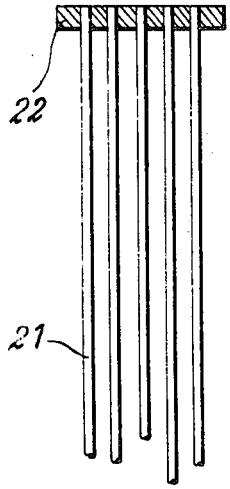
FIGS. 2, 3 and 4 are detail views to a larger scale showing a bundle of tubes employed in the construction of the generator in accordance with FIG. 1.
Figure 3:
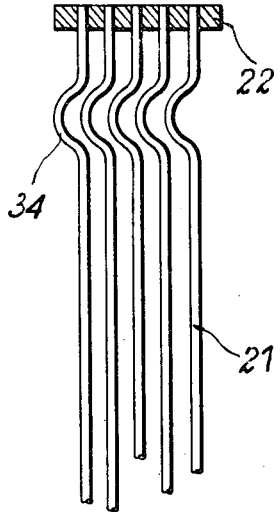
Figure 4:
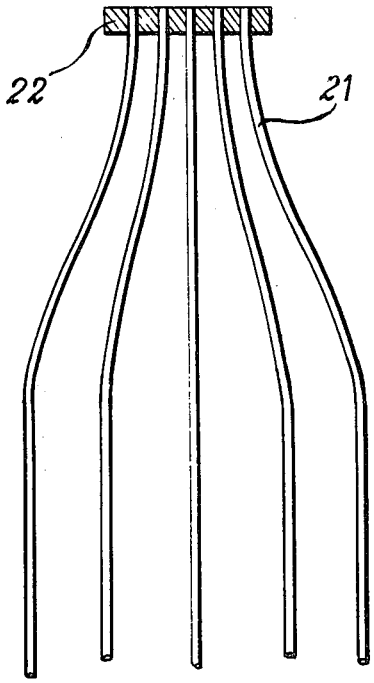

FIGS. 2 to 4 illustrate a number of alternative forms of construction of the tubes 21 in the modular bundles 20 which are employed in the generator under consideration. In FIG. 2, said tubes 21 are intended in particular to be straight tubes directly connected to the tube-plates, for example to the tube-plate 22. In the alternative embodiment shown in FIG. 3, said tubes are connected to the tube-plates by means of expansion-bends 34. Finally, as shown in FIG. 4, the tubes 21 are brought substantially closer together in each bundle 20 and in the vicinity of their connections with the corresponding tube-plate. Said tubes are then spaced at a greater distance from each other before becoming parallel within the casing 1. The result thereby achieved is to ensure a better distribution of said tubes within the casing and more uniform heat exchange with the flow of liquid metal in said casing.

A steam generator which is constructed in accordance with the foregoing arrangements can be readily adapted to high thermal power outputs and offers a large number of advantages both in regard to economic performance and in regard to reliability. This holds true especially in the event of reaction between the liquid metal within the outer casing and the water which circulates within the tubes of the modular bundles in the compartments when leakage occurs in one or a number of said tubes.

The partitioning of the generating unit makes it possible in particular to distribute the total power of the unit within the different compartments and the tube bundles contained within these latter. Moreover, the construction of water-boxes of small diameter permits the use of tubes without expansion-bends whilst the bellows seals fitted on the sleeves which provide a connection with the ends of the casing are sufficient to accommodate dimensional variations during operation. This form of construction permits the use of thin tube-plates.

It is also worthy of note that a judicious choice of the number of compartments such as six, for example, can result in an arrangement which ensures better occupation of the annular cross-sectional area of the shell of the outer casing while facilitating inspection of the tubes, detection of leakages and partial draining of the generating unit. In the event of occurrence of a minor leak in one tube of a modular bundle, it can be readily understood that, after detection of the leak, the defective tube can be plugged simply by cutting the water-boxes 24 and 25 which are associated with the bundle. This can be achieved without any need to disassemble the entire steam generator and thus avoids excessive generator outage time.

A further result achieved by partitioning of the different modular bundles is that these latter can thus be more effectively protected from each other in the event of more substantial leakages and that it is thus possible in particular to prevent propagation of the effects of such leakages from one bundle to the next. It is also possible in the event of such leakages to remove only the tube bundle to be repaired after cutting the water-boxes 24 and 25 externally of the tube-plates 22 and 23 and then cutting the shell 2 at the level of the weld fillet 5 which joins said shell to the dished end 4. Finally, the general design of the steam generator makes it possible to employ either a single tube geometry (which is the case illustrated in FIG. 2) or a limited number of different geometries (case shown in FIG. 4).

What we claim is:

1. A steam generator comprising a closed outer casing of revolution about an axis and containing liquid metal which is circulated within said casing, and a plurality of tube bundles traversed by water in the liquid state to be converted to steam by exchange of heat with the liquid metal, the tubes in each bundle being adapted to pass through the casing and connected at the end of said casing by means of tube-plates to two separate headers respectively for the admission of water and discharge of steam, said tube bundles being arranged in spaced relation within the casing so as to constitute independent modules extending parallel to the axis of said casing, liquid metal being supplied to the casing along its axis through a single central tube so as to fill said casing to a given level, wherein said supply tube is provided with distribution orifices for the flow of liquid metal into adjacent compartments formed in the casing by means of radial partitions extending from the central tube in planes which contain the axis of the casing, each compartment being traversed by at least one tube bundle, the radial partitions being such as to form with the internal surface of the casing a small gap in order to permit a communication between the adjacent compartments and to equalize the level of liquid metal within said compartments.

2. A steam generator according to claim 1, wherein the outer casing is constituted by a lateral cylindrical shell having a vertical axis and closed by two substantially spherical dished ends, liquid metal being circulated downwards within said casing whilst water is circulated upwards within the tubes of the bundles in counterflow to the liquid metal.

3. A steam generator according to claim 1, wherein the central tube for supplying liquid metal within the outer casing is constituted by a cylindrical duct, the distribution orifices being located at the ends of elbowed portions carried by said duct.

4. A steam generator according to claim 1, wherein a volume of neutral gas is present above the level of liquid metal within the casing in order to damp the pressure waves in the event of leakage of a tube and reaction between the water and the liquid metal.

5. A steam generator according to claim 1, wherein the discharge of liquid metal from the outer casing is carried out by means of a single central duct mounted on the bottom end of the casing in the line of extension of the central supply tube.

6. A steam generator accordig to claim 5, wherein the supply tube has an extension to the vicinity of the discharge duct and the end of said tube has a contour of revolution with a profiled generator-line for facilitating the outflow of liquid metal from the outer casing.

7. A steam generator according to claim 1, wherein the bottom end of the outer casing is provided beneath each compartment with a duct for the discharge of liquid metal.

8. A steam generator according to claim 5 or claim 7, wherein the discharge duct is provided externally of the casing with a safety bursting disc so as to permit rapid emptying of the compartments.

9. A steam generator according to claim 1, wherein the tubes of each modular bundle are straight tubes parallel to the axis of the outer casing whilst the tube-plates of the individual headers extend in a horizontal direction.

10. A steam generator according to claim 1, wherein the tubes within each modular bundle are brought closer together in the vicinity of their connection with the tube-plates and spaced at a greater distance from each other within the interior of the compartments formed in the outer casing.

11. A steam generator according to claim 1, wherein the individual headers are connected to the outer casing by means of sleeves each fitted with a bellows seal in order to accommodate expansional differences between the outer casing and the tubes of the modular bundles.

12. A steam generator according to claim 1, wherein each modular bundle is fitted with isolating valves placed in the water admission duct and in the steam discharge duct as well as a drainage valve placed in the water admission circuit in order to limit the total quantity of water which is liable to react with the liquid metal in the event of leakages from the tubes of the modular bundle.

13. A steam generator according to claim 1, wherein the radial partitions are rigidly fixed over the greater part of their height to the central supply tube.

* * * * *